United States Patent [19]

Morozumi

[11] 4,162,608

[45] Jul. 31, 1979

[54] ELECTRONIC TIMEPIECE FREQUENCY REGULATING CIRCUIT

[75] Inventor: Shinji Morozumi, Shimosuwa, Japan

[73] Assignee: Kabushiki Kaisha Suwa Seikosha, Tokyo, Japan

[21] Appl. No.: 834,358

[22] Filed: Sep. 19, 1977

Related U.S. Application Data

[63] Continuation of Ser. No. 583,922, Jun. 5, 1975, abandoned.

[30] Foreign Application Priority Data

Jun. 5, 1974 [JP] Japan ..... 49-63670

[51] Int. Cl.[2] ..... G04C 3/00

[52] U.S. Cl. ..... 58/23 R; 58/85.5; 58/23 D; 58/34; 58/50 R

[58] Field of Search ..... 58/85.5, 23 R, 23 D, 58/34, 50 R

[56] References Cited

U.S. PATENT DOCUMENTS

| | | | |
|---|---|---|---|
| 3,540,207 | 11/1970 | Keeler | 58/23 R |
| 3,541,779 | 11/1970 | Langley | 58/23 R X |
| 3,777,471 | 12/1973 | Koehler et al. | 58/85.5 X |
| 3,812,669 | 5/1974 | Wiget | 58/23 R |
| 3,812,670 | 5/1974 | Nikaido et al. | 58/23 R |
| 3,817,020 | 6/1974 | Esaki | 58/85.5 X |
| 3,895,486 | 7/1975 | Hammer et al. | 58/85.5 X |
| 3,916,612 | 11/1975 | Morokawa et al. | 58/23 R |

*Primary Examiner*—Ulysses Weldon

*Attorney, Agent, or Firm*—Blum, Moscovitz, Friedman & Kaplan

[57] ABSTRACT

An electronic timepiece including a phase circuit for advancing and/or delaying the phase of the frequency signals to thereby regulate the frequency thereof is provided. The electronic timepiece includes an oscillator for producing a high frequency time standard signal and a divider circuit having a series-connected chain of frequency divider stages, at least one of the divider stages in response to the application of the high frequency time standard signal to the divider circuit producing a timekeeping signal. A display is adapted to display time in response to said timekeeping signal applied thereto. The phase changing circuit is series-connected in the series-connected divider chain to thereby apply an intermediate frequency signal from the divider stage just prior thereto to the next divider stage. Additionally, the phase changing circuit is adapted to selectively change the phase of the intermediate frequency signal applied to the next divider stage to effect an adjustment of the frequency of the timekeeping signal produced by the divider circuit.

15 Claims, 12 Drawing Figures

ELECTRONIC TIMEPIECE FREQUENCY REGULATING CIRCUIT

This is a continuation of application Ser. No. 583,922, filed June 5, 1975 now abandoned.

BACKGROUND OF THE INVENTION

This invention is directed to an electronic timepiece frequency regulation circuit and in particular to the advancing and/or retarding of the phase of the frequency in an electronic timepiece to thereby effect frequency regulation thereof.

The component in an electronic timepiece most responsible for the accuracy obtainable thereby is the time standard. The development of the quartz crystal vibrator, and the use thereof in an electronic timepiece oscillator circuit to provide a highly stable high frequency time standard frequency on the order of 32.768 KHz has largely contributed to such accuracy. Nevertheless, although manufactured by the same process under the same conditions, the frequency at which such quartz crystal vibrators oscillate has been found to be highly and unexpectedly varied.

It has therefore been necessary to regulate the frequency of the oscillator circuit by effecting mechanical changes to the vibrator itself such as removal of mass from the electrodes of the vibrator, or the changing of the circuit design of the oscillator circuit. Additionally, the fine adjustment of the frequency is effected by a trimmer arrangement, usually in the form of one or several adjustable capacitors, for permitting an accurate adjustment of the high frequency time standard signal produced by the oscillator circuit. Such trimmer arrangements are capable of varying the high frequency time standard over a range of 1 Hz when the high frequency time standard signal required is 32.768 KHz. Thus, when the quartz crystal vibrator oscillates at frequencies which are not within 0.5 Hz above and below the 32.768 KHz time standard value, such vibrators are unacceptable for use in an electronic timepiece. Accordingly, to provide such a quartz crystal vibrator within 0.5 Hz of the high frequency time standard required for accurate operation of an electronic timepiece, numerous manufacturing processes and considerable expense are required to produce such a quartz crystal vibrator.

SUMMARY OF THE INVENTION

Generally speaking, in accordance with the invention, an electronic timepiece including a phase changing circuit for effecting frequency regulation is provided. An oscillator circuit is adapted to produce a high frequency time standard signal and a divider circuit having a series-connected chain of frequency divider stages with at least one of the divider stages in response to the application of the high frequency time standard signal to the divider circuit being adapted to produce a timekeeping signal. A display is coupled to the divider circuit and is adapted to display time in response to the timekeeping signal applied thereto. The electronic timepiece is characterized by the phase changing circuit being series-connected in the series-connected divider chain for applying an intermediate frequency signal from the divider stage just prior thereto to the next divider stage, the phase changing circuit being further adapted to selectively change the phase of the intermediate frequency signal applied to the next divider stage to thereby effect an adjustment of the frequency of the timekeeping signal produced by the divider circuit.

Accordingly, it is an object of this invention to provide a highly accurate quartz crystal electronic timepiece capable of being less dependent on the accuracy of the quartz crystal vibrator.

Still a further object of this invention is to provide an improved quartz crystal electronic timepiece wherein frequency regulation is effected by selectively changing the phase of the time frequency signal to thereby effect an advance and/or retard of the count thereof.

Still a further object of this invention is to provide a highly accurate electronic timepiece wherein the cost of providing a quartz crystal vibrator is minimized.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

BRIEF DESCRIPTIONS OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
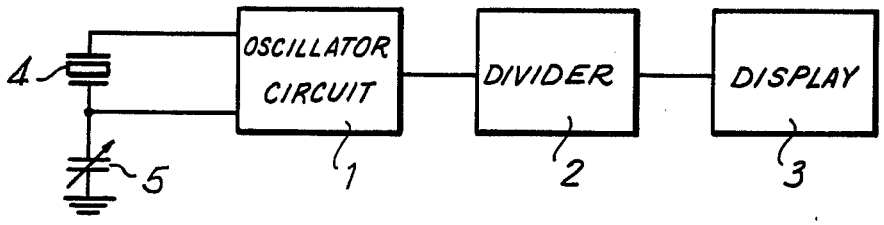
FIG.1 PRIOR ART
FIG. 1 is a block circuit diagram of an electronic timepiece constructed in accordance with the prior art.

Referring to FIG. 1, an electronic timepiece of the type well known in the prior art is depicted. A high frequency time standard signal is produced by an oscillator circuit 1, and is applied to a divider circuit 2. Divider circuit 2 is formed of a series-connected chain of frequency divider stages and in response to the high frequency time standard signal produced by the oscillator circuit 1 effects a division of the high standard frequency to thereby produce low frequency timekeeping signals. A display 3, either analog or digital, is adapted to display time in response to the timekeeping signals applied thereto. The oscillator circuit and divider circuit are formed of C-MOS circuit elements integrated onto circuit chips to provide for a small-sized electronic timepiece capable of providing accurate timekeeping.

The oscillator circuit 1 is adapted to produce a highly stable, high frequency time standard signal by the use of a quartz crystal vibrator 4 as a time standard. Additionally, fine tuning of the frequency produced by the oscillator circuit 1 is achieved by an adjustable trimmer capacitor 5 coupled thereto. Oscillator circuits having a quartz crystal vibrator as a time standard, and an adjustable capacitor as a trimmer element are capable of varying the frequency over a range of 1 Hz. Thus, for a conventional electronic timepiece having a divider circuit capable of producing timekeeping signals in response to a high frequency time standard signal of 32.768 KHz, if the frequency at which the quartz crystal vibrator oscillates is not within a range of 0.5 Hz above or 0.5 Hz below the 32,768 KHz value, the trimmer capacitor becomes insufficient to effect the necessary frequency regulation. Accordingly, although manufacture of quartz crystal vibrators capable of providing highly stable oscillation within the range noted above are obtainable, the excess costs caused by the numerous additional processing requirements for manufacturing such a quartz crystal vibrator have rendered their use to be less than completely satisfactory.

Figure 2:
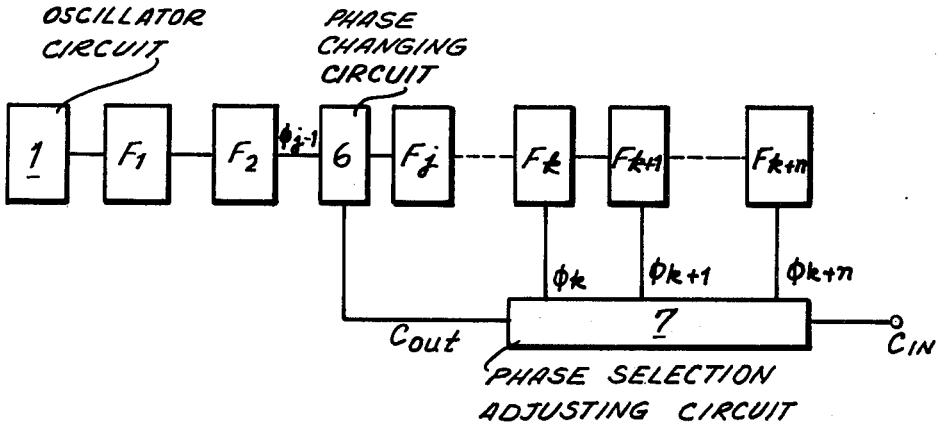
FIG. 2 is a block circuit diagram of a frequency regulation circuit constructed in accordance with the instant invention.

Reference is now made to FIG. 2 wherein a frequency regulation circuit for eliminating the necessity of having to provide a highly accurate quartz crystal vibrator is provided. The series-connected divider circuit includes a plurality of series-connected divider stages $F_1$ through $F_{k+n}$ comprising a divider chain adapted to produce low frequency timekeeping signals in response to the high frequency time standard signal produced by the oscillator circuit 1. A phase changing circuit 6 is included in the series-connected divider chain between divider stage $F_2$ and divider stage $F_j$. As detailed below, the selection of the divider stages in the divider-chain between which the phase changing circuit is disposed is optional, and is dictated only by power consumption requirements and/or the amount of frequency adjustment to be effected thereby. The phase changing circuit is adapted to receive the output $\phi_{j-1}$ from the divider stage $F_2$, and apply same to the next divider stage $F_j$ changed in phase by "n" times 180° within a fixed period of time. The number of phase changes during a predetermined period of time is determined by the application of a phase selection adjusting signal $C_{out}$ produced by phase selection adjusting circuit 7. Phase selection adjusting circuit 7 is adapted to receive low frequency signals $\phi_k$ through $\phi_{k+n}$ produced by divider stages $F_k$ through $F_{k+n}$ and in response thereto effect n phase changes of 180° during a predetermined period determined by the rising and falling edges of the signal $C_{out}$ hence the number of times signal $C_{out}$ changes state during a predetermined period. Moreover, the number of times that $C_{out}$ changes state is determined by control signals $C_{IN}$ applied to phase selection adjusting circuit 7 for selecting the divider stage inputs to be combined and applied to the phase changing circuit.

Figure 3:
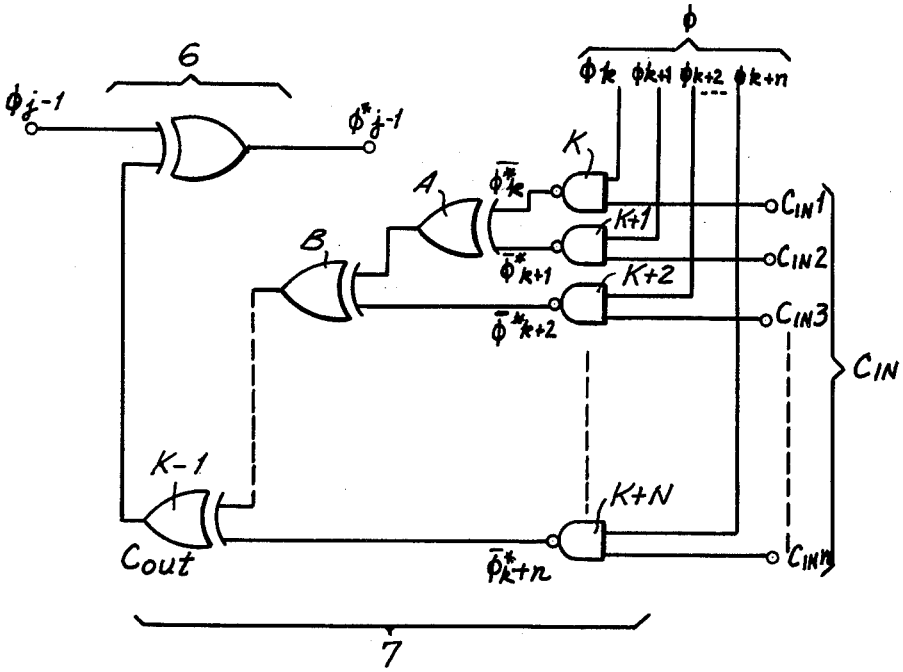
FIG. 3 is a detailed circuit diagram of the frequency regulation circuit depicted in FIG. 2.
Figure 4:
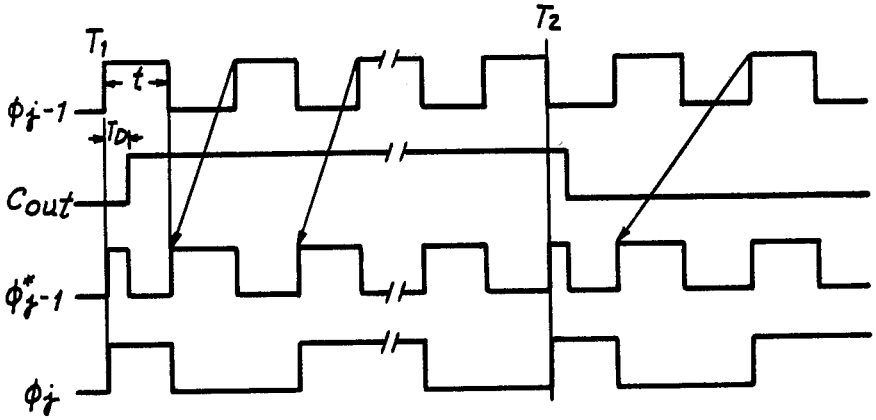
FIG. 4 is a wave diagram illustrating the operation of the phase circuit depicted in FIGS. 2 and 3.
Figure 5:
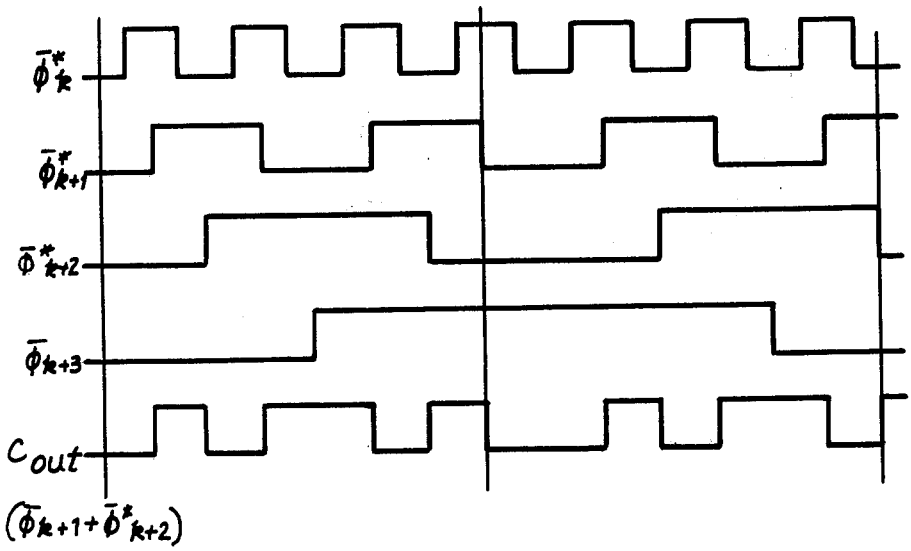
FIG. 5 is a wave diagram illustrating the operation of the phase selection adjusting signal circuit depicted in FIGS. 2 and 3.
Figure 6:
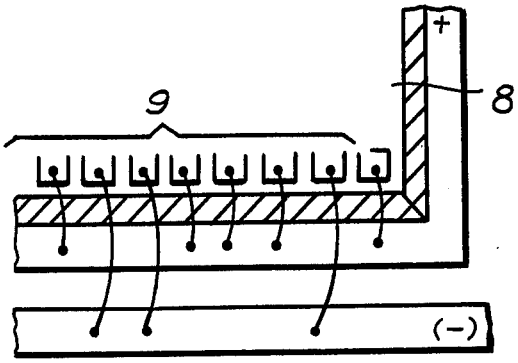
FIG. 6 illustrates the manner in which bonding of the frequency regulation circuit is effected in an electronic timepiece incorporating the instant invention.

Reference is now made to FIGS. 3, 4 and 5 wherein a specific embodiment of the circuit depicted in FIG. 2 is illustrated and wherein regulation of the timekeeping signal produced by the divider circuit is effected by advancing the phase of the frequency signal by 180°. Phase changing circuit 6 is comprised of an EXCLUSIVE OR gate 6 coupled intermediate divider stages $F_2$ and $F_j$. Accordingly, EXCLUSIVE OR gate 6 is adapted to receive the intermediate frequency output $\phi_{j-1}$ from divider state $F_2$ as a first input, and the phase selection adjusting signal $C_{out}$ from the phase selection adjusting circuit. When the phase selection adjusting signal $C_{out}$ is LOW or "0" the intermediate frequency signal applied to the next divider stage $F_j$ is the output signal $\phi_{j-1}$ produced by divider stage $F_2$. However, in response to a change of the phase selection adjusting signal $C_{out}$ from a LOW state to a HIGH state and, after a predetermined period of time, a return from a HIGH state to a LOW state, the EXCLUSIVE OR gate 6 effects an advancement of the phase by 180° for each rise and fall thereof. Thus, as is specifically detailed in FIG. 4, if $C_{out}$ changes from a LOW to a HIGH state at a time $T_D$ later than the time $T_1$, the EXCLUSIVE OR gate produces a signal $\phi^*_{j-1}$, the phase thereof having been advanced by 180° in response to a change of state. Additionally in response to a fall of the phase selection adjusting signal $C_{out}$ from a HIGH to a LOW, the signal $\phi^*_{j-1}$ applied to the next divider stage $F_j$ is once again advanced by 180°.

As is explained in greater detail below with respect to the explanation of the operation of the phase selection adjusting circuit depicted in FIG. 5, $C_{out}$ has a period equal to the period of one of the signals $\phi_k$ through $\phi_{k+n}$, or a combination thereof, applied to the selection adjusting circuit 7. Although an ideal operation of the circuit would indicate that the signal $C_{out}$ would be synchronous with the output signal $\phi_{j-1}$ produced by divider stage $F_2$, during actual operation of such a circuit, a time delay $T_D$ proportional to the number of series-connected divider stages after the next-divider stage following the phase adjusting circuit results therefrom. Specifically, if the time delay per stage equals $\tau_D$, then the delay $T_D$ of the rise or fall of the phase selection adjusting signal $C_{out}$ in response to an output signal $\phi_{k+i}$ is as follows:

$$T_D=(K-J+i)\times\tau_D,$$

where $i=0, 1, \ldots n$ it being noted that such a relationship does not include the time delays inherent in the phase selection adjusting circuit 7. Nevertheless, as is specifically depicted in FIG. 4, the time delay $T_D$ is utilized to advance the phase of the output signal produced by the next previous divider stage to the next divider stage by 180° for each rise and for each fall of the signal $C_{out}$, when the phase changing circuit is an EXCLUSIVE OR gate. Accordingly, if the signal $\phi_{j-1}$, which signal is to have the phase thereof advanced, is assumed to have a frequency of f for a phase-advance of 180°, a change of 1/2f is effected on the output side of the divider stage producing same.

Because the number of times that the phase of the signal produced by the next-previous divider stage $F_2$ is advanced is determined by the signal $C_{out}$ produced by the phase selection adjusting circuit, FIGS. 3 and 5 particularly illustrate the circuit for producing same. The respective outputs $\phi_k$ through $\phi_{k+n}$ respectively produced by divider stages $F_k$ through $F_{k+n}$ are applied as first inputs to NAND gates K, K+1 through K+N. Each NAND gate K through K+N includes as a second input control signals $C_{IN1}$ through $C_{INn}$. Accordingly, each NAND gate remains closed in response to a HIGH level input signal at the $C_{IN}$ terminal, and in response to a LOW signal applied at the $C_{IN}$ terminal is opened and effects an inversion and transmission of the divider stage output signal $\phi$ applied thereto. In the preferred embodiment depicted in FIGS. 2 and 3, the divider stages $F_k$ through $F_{k+n}$ are binary divider circuits adapted to effect division of the frequency applied thereto by one-half. Accordingly, when for example, only the output of the last divider stage $\phi_{k+n}$ is applied to NAND gate K+N the rise and fall of the phase selection adjusting signal $C_{out}$ occurs only once within a time period $T_B$ if $T_B$ represents the period of a low frequency timekeeping signal produced by the last divider stage. The amount of frequency regulation effected thereby would therefore be:

$$1/2f \times 2.$$

Similarly, when NAND gate K+N−1 is opened by the input $C_{INn-1}$, the rise and fall of the signal $C_{out}$ occurs twice during a period $T_B$, and hence the amount of frequency regulation equals:

$$1/2f \times 4$$

for each period $T_B$. Accordingly, for the output $\phi_k$, the amount of frequency regulation for the period $T_B$ equals:

$$1/2f \times 2^{(n+1)}.$$

Thus, the range of frequency regulation is between:

$$0 \text{ and } 1/2f \times 2^{(n+1)}$$

and can be selected at successive steps of 1/2f×2 for each period of the timekeeping signal $T_B$.

Referring specifically to FIGS. 3 and 5 the amount of frequency regulation effected by phase change circuit 6, and the manner in which the phase selection adjusting signal $C_{out}$ is determined is illustrated. As detailed above, each of the leading edges of the respective output signals from the binary divider stages $\phi_k$ through $\phi_{k+n}$ are delayed in the manner illustrated in FIG. 5. Accordingly, by utilizing EXCLUSIVE OR gates A through K-1, the delay between the output signals $\phi$ from each divider stage can be utilized to select the number of rises and falls of the phase selection adjusting signal $C_{out}$ applied to phase changing circuit 6. Thus, if, as depicted in FIG. 5, only the $C_{IN}$ inputs to NAND gates K+1 and K+2 are LOW, and the remaining $C_{IN}$ inputs to NAND gates K, K+3 through K+N are maintained HIGH, signal $\phi_{k+1}$ is applied through EXCLUSIVE OR gate A to EXCLUSIVE OR gate B as a first input thereto, and the output signal $\phi_{k+2}$ from NAND gate K+2 is applied as the other input to EXCLUSIVE OR gate B, and phase selection adjusting signal $C_{out}$ is produced as an output thereof, and is successively applied through the remaining EXCLUSIVE OR gates A through K-1 to produce the output $C_{out}$ depicted in FIG. 5.

In an actual example, if the frequency of the signal applied to the phase changing circuit is 8.192 KHz, the actual time advance for each phase advance of 180° equals $$\frac{1}{2 \times 8.192 \times 10^3} = 60\ \mu\text{sec},$$

and

60 μsec×86,400 seconds/day=5.2 seconds per day, which number of seconds per day equals a half period of the divider stage just prior to the phase circuit. Moreover, if the periods of the outputs $\phi_k$, $\phi_{k+1}$ and $\phi_{k+2}$ of the respective divider stages are 1 second, 2 seconds and 4 seconds, respectively, the amount of frequency regulation obtainable thereby is illustrated below in Table 1. Accordingly it is possible to obtain frequency regulation to a range of nearly 20 seconds.

TABLE 1

| step | passing signal | amount of advance (second/day) |
|---|---|---|
| 1 | 0 | 0 |
| 2 | $\phi_{k+2}$ | about 2.6 |
| 3 | $\phi_{k+1}$ | about 5.2 |
| 4 | $\phi_{k+1} + \phi_{k+2}$ | about 7.8 |
| 5 | $\phi_k$ | about 10.4 |
| 6 | $\phi_k + \phi_{k+2}$ | about 13.0 |
| 7 | $\phi_k + \phi_{k+1}$ | about 15.6 |
| 8 | $\phi_k + \phi_{k+1} + \phi_{k+2}$ | about 18.2 |

Moreover, if the high frequency time standard signal produced by the oscillator circuit is 32.768 KHz, frequency regulation over a range of nearly 7.7 Hz (0.023%) is obtainable. Additionally, after selecting the step for obtaining the desired frequency regulation to the nearest interval of 2.6 seconds per day desired fine tuning of the oscillator is obtained by varying the trimmer capacitor 5 depicted in FIG. 1.

Additionally, the selection of the control signals $C_{IN}$ are effected by selectively coupling the pads on integrated circuit chip 8, corresponding to the input terminals of NAND gates K through K+N, through bonding wires to either a positive (+) or HIGH terminal by referencing integrated circuit chip 8 to a positive (+) potential or through bonding wires to a negative (−) potential to thereby effect the application of one of a HIGH or LOW control signal to the respective NAND gates. Such a feature facilitates the frequency regulation of the electronic timepiece and allows same to be achieved either during manufacture or during repair.

It is noted, that the range over which the frequency regulation of the series-connected divider chain can be adjusted is determined by the frequency of the output signals $\phi_k$ to $\phi_{k+n}$ utilized to synthesize the phase selection adjusting signal $C_{out}$. Additionally, if the interval of time between each regulation step is sufficiently reduced, elimination of the trimmer capacitor can result.

It is further noted that when a series-connected divider-chain is formed from C-MOS integrated circuits, the current consumption in the electronic timepiece is proportional to the operating frequency. Accordingly, positioning of the phase changing circuit to effect adjustment of the phase at a position in the divider-chain closer to the higher frequency divider stages, such as for example after the oscillator circuit and immediately prior to the first divider stage, will increase the current consumption of the electronic timepiece. Moreover, as the time delay $T_D$ of the divider circuit approaches a half period of the output signal from the divider stage to be phase adjusted, as is noted in FIG. 4, the frequency regulation becomes less stable in response to changes in the supply voltage and/or the variations in the operating characteristics of the transistor, etc. For example, in an C-MOS transistor, particularly for a 1.5 volt operation, there is a large change in the time delay $T_B$ caused by the change of the supply voltage or the variation of the transistor characteristic. Accordingly, in the case of an electronic timepiece having a high frequency time standard of 32.768 KHz, in a preferred embodiment, the phase adjusting circuit is disposed after the divider stage producing an 8KHz signal, which divider stage would follow the first two divider stages if the divider stages in the chain are binary dividers, and would represent the optimum frequency regulation position for providing a minimum of increase in current consumption.

Figure 7:
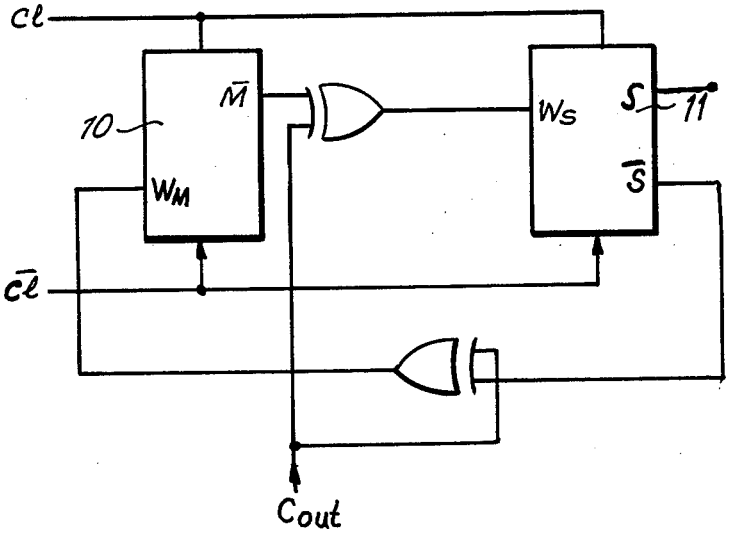
FIG. 7 is a block circuit diagram of a phase changing circuit constructed in accordance with an alternate embodiment of the instant invention.

Reference is now made to FIG. 7, wherein a master-slave divider circuit comprised of master divider stage 10 and slave divider stage 11 is depicted. When such master-slave flip-flop divider circuits are utilized in a series-connected divider chain, the phase adjustment circuit is comprised of EXCLUSIVE OR gates respectively coupling the output signals M and S of the master and slave divider stages to the respective write in terminals $W_S$ and $W_M$ of the slave and master divider stages. Accordingly, the same phase advancement detailed in FIG. 3 is obtained in a master-slave flip-flop divider stage arrangement by changing the phase of the feedback signals applied to the write-in terminals of the respective divider stages to thereby change the phase of the output clock signals at S and S in response to input clock pulses C1 and C1 applied thereto.

The phase changing circuits hereinabove described are directed to the advancement of the frequency to effect regulation thereof. Nevertheless, by utilizing the EXCLUSIVE OR gate phase circuits in combination with a phase-delay circuit, or in the alternative by providing a phase adjustment circuit capable of providing for advancing or delaying the frequency, it is possible to entirely minimize any unwanted advancements or delays of the timekeeping signal caused by the quartz crystal vibrator.

Figure 8:
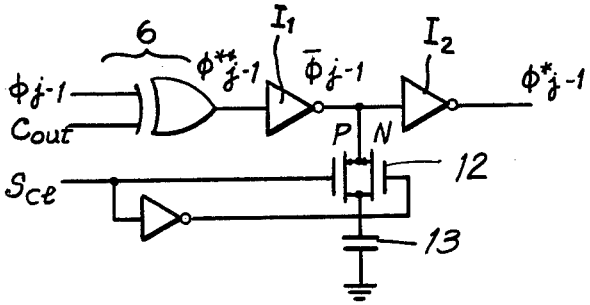
FIG. 8 is a circuit diagram of a phase changing circuit for effecting frequency regulation constructed in accordance with an alternate embodiment of the instant invention.
Figure 9:
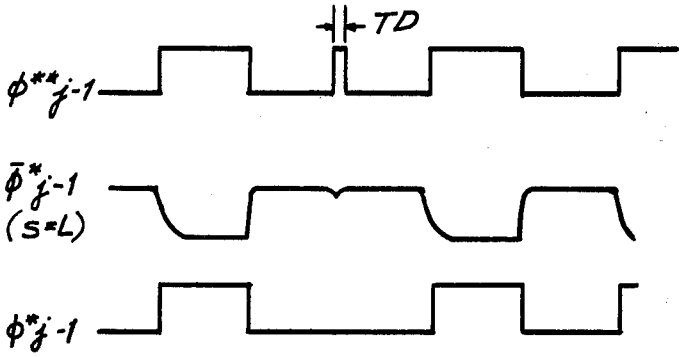
FIG. 9 is a wave diagram illustrating the operation of the phase changing circuit depicted in FIG. 8.

Reference is now made to FIGS. 8 and 9, wherein a phase adjustment circuit adapted to provide advancement and/or delay of the frequency is depicted. The signal $\phi^{}_{j-1}$ produced by the EXCLUSIVE OR gate includes a narrow pulse having a width $T_D$, which pulse is applied through respective inverter circuits, $I_1$ & $I_2$, a transmission gate 12 comprised of two complementary coupled MOS transistors defining an equivalent impedance, and a capacitor 13 coupled to a reference potential such as ground. The transmission gate 12 and capacitor 13 define an integration circuit having a RC constant. Specifically, when $S_{ce}$ is on a HIGH level, the transmission gate 12** is maintained in an OFF state by said advance-delay control signal $S_{ce}$ and the signal produced from the OR gate is applied to the next divider stage to thereby produce phase advancement pulse $\phi^*_{j-1}$ as detailed above in the description of FIG. 3. Alternatively, when the advance-delay signal $S_{ce}$ is a LOW level signal, the equivalent impedance of the transmission gate 12 and capacitor 13 provide a RC integration circuit for smoothing out the narrow pulse width $T_D$. Accordingly, the removal of the pulse is effected by selecting the equivalent impedance of the transmission gate 12 and the capacitor 13 to effect a time constant capable of integrating out a pulse width formed by the delay $T_D$ noted above and thereby delays the frequency by 180° for each narrow pulse width $T_D$ smoothed out of the pulse train. Although FIG. 8 depicts a preferred embodiment of an integration circuit, it is noted that the instant invention contemplates the use of other integration circuitry. For example, the integration can be effected by utilizing the output resistor of the inverter circuit producing the output $\phi_{j-1}$. It is noted that due to the asynchronous operation of the electronic timepiece, and hence the benefit of not having to synchronize the operation to the clock pulse $\phi_{j-1}$, a simplified electronic timepiece arrangement for regulating the frequency is provided.

Figure 10:
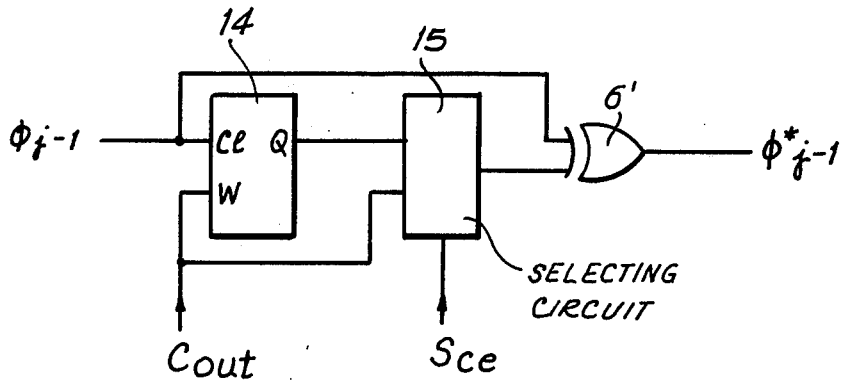
FIG. 10 is a circuit diagram of a phase changing circuit for effecting frequency regulation by advancing or retarding the frequency constructed in accordance with still another embodiment of the instant invention.
Figure 11:
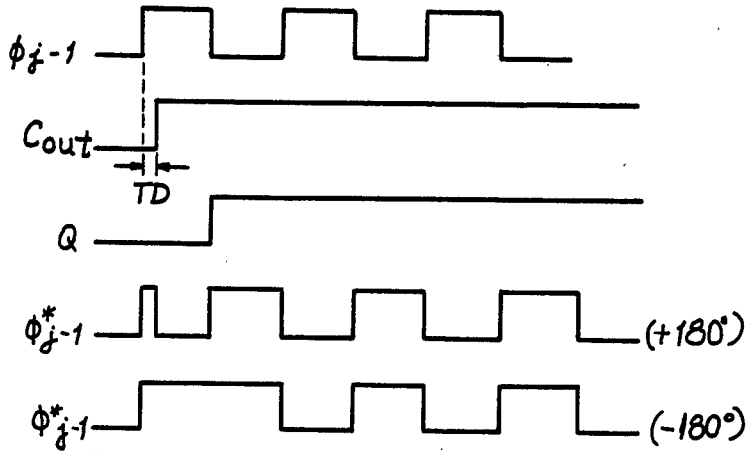
FIG. 11 is a wave diagram illustrating the operation of the phase changing circuit depicted in FIG. 10.

Reference is now made to FIGS. 10 and 11 wherein a phase adjustment circuit capable of providing phase advancement and/or delay is depicted. A flip-flop circuit 14 is adapted to receive the output signal $\phi_{j-1}$, from the next-previous divider stage, the phase of which is to be changed. Additionally, the output signal from the next-previous divider stage is applied as a first input to the EXCLUSIVE OR gate 6'. The flip-flop circuit is also adapted to receive as a further set-reset input the phase selection adjusting signal $C_{out}$ and in response to a setting thereby produce an output Q in response to the next change of state of the output signal $\phi_{j-1}$ from the previous divider. Additionally, the signal $C_{out}$ is applied as a first input to selecting circuit 15. An additional input to selecting circuit 15 is the output Q from from the flip-flop 14. Finally, an advance-delay control signal $S_{ce}$ is applied to selecting circuit 15 and in response thereto, either the output Q from the flip-flop circuit 14 or the phase selection adjusting signal $C_{out}$ is applied as a second input to EXCLUSIVE OR gate 6'. The selecting circuit 15 could be comprised of two AND gates, a first AND gate being adapted to receive the Q output as a first input, and the second AND gate being adapted to receive the $C_{out}$ signal as a first input. Also, the first AND gate receiving the Q output would receive signal $S_{ce}$ as a second input, whereas the second AND gate would receive the inverse of $S_{ce}$ as a second input. By applying the output from both AND gates to an OR gate, either $C_{out}$ or Q would be transmitted to the EXCLUSIVE OR gate, selection thereof determining advance or delay. As depicted in FIG. 11, if the Q output from the flip-flop 14 is applied by selecting circuit 15 to EXCLUSIVE OR gate 6', a phase delay of −180° is effected. Alternatively, if the signal $C_{out}$ is applied to the EXCLUSIVE OR gate 6' by selecting circuit 15, a phase advance of 180° is effected.

Figure 12:
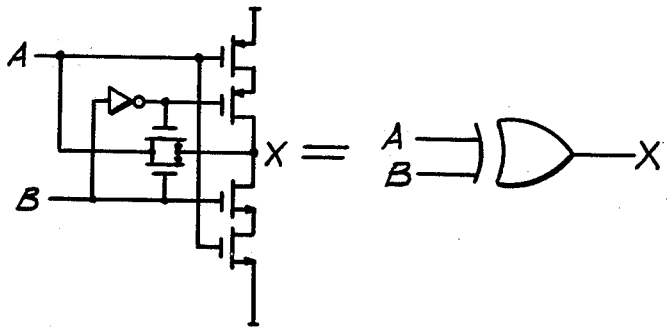
FIG. 12 is a detailed circuit diagram of the phase changing circuit depicted in FIGS. 2 and 3.

From the foregoing description of the preferred embodiments, it is apparent that the instant invention is characterized by the use of a phase changing circuit capable of providing for advancement and/or delay of the division ratio of a divider chain by 180° of the phase of a signal produced by one of said divider stages in the chain. As illustrated in FIG. 3, and explained in detail above, one such phase-changing circuit is an EXCLUSIVE OR gate comprised entirely of a C-MOS elements coupled in the manner depicted in FIG. 12. The instant invention is additionally characterized by the advancement of the frequency, without the necessity of providing synchronous operation of each of the divider stages, and instead advantageously utilizing the time delay of each subsequent divider stage in a beneficial manner to obtain improved frequency regulation. The elimination of the necessity of synchronization further renders the circuits, such as an EXCLUSIVE OR gate of considerably simpler construction, thereby providing a further benefit in terms of reduced cost thereto.

Finally, it is noted that the range over which frequency regulation is obtainable allows the use of an inexpensive quartz crystal vibrator as a high frequency time standard. Moreover, the wide range of frequency adjustment rendered available to an electronic timepiece by the instant invention makes it possible to operate the oscillator circuit at a frequency guaranteeing a high degree of stability thereby taking advantage of a benefit which inures to quartz crystal vibrators. Moreover, from the discussion above, it is clear that reduced current consumption and highly stable operation is obtainable thereby. Also, by utilizing an extremely simple circuit arrangement for effecting the regulation of the frequency, such circuit being particularly suited for being monolithically integrated into a single circuit chip, the cost of manufacturing the electronic timepiece is reduced and an improved electronic timepiece is provided.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. In an electronic timepiece including oscillator means for producing a high frequency time standard signal, divider means having a series-connected chain of frequency divider stages, at least one of said divider stages in response to the application of said high frequency time standard signal to said divider means producing a timekeeping signal, and display means adapted to display time in response to said timekeeping signal applied thereto, the improvement comprising phase changing means series-connected to said series-connected divider chain between a divider stage just prior thereto and a next divider stage for applying an intermediate frequency signal from said divider stage just prior thereto to said next divider stage, phase selection adjusting signal means coupled to at least one of said series-connected divider stages in said divider chain after said next divider stage for receiving a control frequency signal produced thereby, and in response thereto selectively applying a two-state phase selection adjusting signal to said phase changing means, said phase changing means being adapted to be selectively disposed into one of a retard mode and an advance mode, said phase changing means in response to said intermediate frequency signal produced by the divider stage just prior thereto and the phase selection adjusting signal being adapted to apply to the next divider stage said intermediate frequency signal retarded by at least 180° for each change of state of said phase selection adjusting signal applied thereto when said phase adjustment means is disposed in a retard mode, said phase changing means being further adapted in response to the intermediate frequency signal produced by the divider stage just prior thereto and the phase selection adjusting signal applied thereto to apply to the next divider stage said intermediate frequency signal advanced by at least 180° for each change of state of said phase selection adjustment signal applied thereto when said phase changing means is disposed in an advance mode.

2. In an electronic timepiece as claimed in claim 1, wherein said phase selection adjusting signal means produces a phase selection signal having a leading and falling edge delayed in time from the leading edge of said intermediate frequency signal produced by said divider stage just prior to said phase changing means, and gating means for producing a gating output signal formed by adding a narrow pulse having a pulse width equal to the delay between the occurrence of said leading and falling edges of said phase selection adjusting signal and said intermediate frequency signal at the time of phase change to said intermediate frequency signal produced by said divider stages just prior to said phase changing means, said phase changing means including selecting circuit means coupled intermediate said gating means and said next divider stage, said selecting circuit means being adapted to be selectively disposed into one of an advance mode and a retard mode, said selecting circuit means being adapted to apply said gating output signal to said next divider stage when said selecting circuit means is disposed in an advance mode, said selecting circuit means being further adapted to inhibit said narrow pulse in said gating output signal from being applied to said next divider stage when said selecting circuit is in a retard mode, to thereby delay the intermediate frequency signal applied to the next divider stage by a phase of 180° for each narrow pulse inhibited therefrom.

3. An electronic timepiece as claimed in claim 1, wherein said phase changing means includes an EXCLUSIVE OR gate means.

4. An electronic timepiece as claimed in claim 1, wherein said phase changing means in response to each selective application of said phase selection adjusting signal is adapted to effect one of an advance and retard of said intermediate frequency signal by changing the phase thereof by 180°.

5. An electronic timepiece as claimed in claim 1, wherein said phase selection means is adapted to produce a phase selection adjusting signal having leading and falling edges defined by said changes of state thereof delayed with respect to the leading and falling edges of said intermediate frequency signal produced by said divider stage just prior said phase changing means.

6. An electronic timepiece as claimed in claim 5, wherein said phase changing means in response to the selective application of said phase selection adjusting signal is adapted to effect one of an advance and delay of the phase of said intermediate frequency signal applied to said next divider stage in response to each leading and falling edge of said phase selection adjusting signal.

7. An electronic timepiece as claimed in claim 6, wherein said phase changing means includes a binary logic gate means and in response to the respective states of said intermediate frequency signal and said phase selection adjusting signal being the same, is adapted to produce a signal of a first state, and in response to the respective binary states of said intermediate frequency signal and said phase selection adjusting signal being different is adapted to produce a signal of a second state.

8. An electronic timepiece as claimed in claim 7, wherein said binary logic gate means is an EXCLUSIVE OR gate.

9. An electronic timepiece as claimed in claim 1, wherein said phase selection adjusting signal means includes first logic gate means adapted to receive as a first input signal said control frequency signal, said second input being referenced to one of a first and second opposite potentials, said logic gate means when referenced to said first potential, producing said phase selection adjusting signal, said logic gate means being maintained in a closed position to prevent application of said phase selection adjusting signal in response to a referencing of said logic gate means to said second potential.

10. An electronic timepiece as claimed in claim 9, wherein said logic gate means includes two control frequency signal selecting circuit means respectively coupled to different divider stages later than said next divider stage, each of said control frequency selecting gate means being adapted to receive as a first input the control frequency signal produced by the associated divider stage a second input thereof being respectively coupled to one of said first and second potentials, said respective potential determining whether said control signal selecting signal circuit means transmits said respective control frequency signals applied thereto, and output means coupled intermediate said control frequency selecting circuit means and said phase changing circuit, said output means having as a first input the output of said first control frequency signal selecting circuit means and a second input the output of said second control frequency signal selecting means, and in response thereto, producing said selection adjusting signal having a first state in response to said input signals applied thereto having the same state, and a second state in response to said input signals applied thereto having opposite states.

11. An electronic timepiece as claimed in claim 10, and including N additional control frequency selection circuit means each associated with a divider stage later than said next divider stage and adapted to selectively transmit control frequency signals produced by the associated divider stages in said divider chain, said output means includes N+1 output gate means, a first output gate means being coupled to said control frequency signal selecting circuit gate means adapted to transmit said two highest control frequency signals, each said further output gate means being coupled to receive the output of said last-mentioned output gate means as a first input and the next highest control frequency signal as a second input.

12. In an electronic timepiece as claimed in claim 1, wherein said phase selection adjusting signal means produces a phase selection signal having a leading and falling edge delayed in time from the leading edge of said intermediate frequency signal produced by said divider stage just prior to said phase changing means, said phase changing means being adapted to advance the phase of a timekeeping signal by 180° in response to each leading and falling edge of said phase selection adjusting signal defined by the changes in state thereof, to thereby apply to said next divider stage an intermediate frequency signal having a first pulse width equal to the delay between the occurrence of said leading and falling edges of said phase selection adjusting signal and said intermediate frequency signal at the time of phase change, said intermediate frequency signal thereafter having the same period.

13. In an electronic timepiece as claimed in claim 12, and including integration means disposed in said series-connected divider chain between said phase changing means and said next divider stage, said integration means being adapted to be selectively disposed into a retard mode to effect integration of pulses having a pulse width narrower than the pulse width of said intermediate frequency signal applied to said next divider stage but insufficient to effect integration of said intermediate frequency signal, to thereby effect a delay in the phase of said intermediate frequency signal applied to said next divider stage of 180° for each narrow interval pulse applied thereto.

14. In an electronic timepiece as claimed in claim 13, wherein said phase changing means includes EXCLUSIVE OR gate means adapted to receive said intermediate frequency signal and said phase selection adjusting signal, and in response thereto produce narrow interval pulses, and said integration circuit means including transmission gate means having an impedance defining a time constant capable of integrating said narrow interval pulses produced by said EXCLUSIVE OR gate means when said integrating means is disposed in a retard mode to effect said 180° phase delay in response to each narrow pulse interval produced by said EXCLUSIVE OR gate means.

15. An electronic timepiece as claimed in claim 1, said phase changing means including EXCLUSIVE OR gate means adapted to receive said intermediate frequency signals, flip-flop meand adapted to receive said intermediate frequency signal and said phase selection adjusting signal, said flip-flop being set in response to said phase selection adjusting signal to produce a pulse in response to the next change in state of the intermediate frequency signal applied thereto, and selector means coupled to said flip-flop means for receiving said pulse produced thereby, said selector means also being adapted to receive said phase selection adjusting signal and an advance-delay selection signal, said selection circuit being adapted to apply said output of said flip-flop to said EXCLUSIVE OR gate means in response to a first state of said advance-delay selection signal to effect a delay of the phase of said intermediate frequency signal and to apply to said EXCLUSIVE OR gate means said phase selection adjusting signal in response to a second state of said advance-delay selection signal to effect an advancing of the phase of said intermediate frequency signal in response to the selective application of said phase selecting adjusting signal thereto.

* * * * *